US011607039B1

(12) United States Patent
Thacker

(10) Patent No.: US 11,607,039 B1
(45) Date of Patent: Mar. 21, 2023

(54) FIREARM READY ACCESS DISPLAY RACK

(71) Applicant: Timothy Thacker, Afton, VA (US)

(72) Inventor: Timothy Thacker, Afton, VA (US)

( * ) Notice: Subject to any disclaimer, the term of this patent is extended or adjusted under 35 U.S.C. 154(b) by 0 days.

(21) Appl. No.: 17/538,157

(22) Filed: Nov. 30, 2021

(51) Int. Cl.
*A47B 81/00* (2006.01)

(52) U.S. Cl.
CPC ..... *A47B 81/005* (2013.01)

(58) Field of Classification Search
CPC ..... A47B 81/00; A47B 81/005
USPC ..... 211/64
See application file for complete search history.

(56) References Cited

U.S. PATENT DOCUMENTS 1,202,588 A * 10/1916 Roberts ..... A47B 81/00 312/297
1,932,638 A * 10/1933 Rogers ..... F41C 33/06 206/317
D126,088 S * 3/1941 Clouse ..... 211/64
2,285,035 A * 6/1942 Kenney ..... F41A 23/18 273/148 R
2,616,566 A * 11/1952 Levy ..... A47B 81/005 211/64
2,623,639 A * 12/1952 Levy ..... A47B 81/005 211/64
2,667,274 A * 1/1954 Diebold ..... A47B 81/005 211/64
2,710,100 A * 6/1955 Vermillion ..... A47B 81/007 211/64
2,752,046 A * 6/1956 Levy ..... A47B 81/005 211/64
2,946,452 A * 7/1960 Caloiero ..... A47B 81/005 211/64
2,958,423 A * 11/1960 Caloiero ..... A47B 81/005 211/64
3,031,069 A * 4/1962 Hirsch ..... F41C 33/06 211/64
3,180,494 A * 4/1965 Levy ..... A47B 81/005 108/31
3,288,304 A * 11/1966 Graves ..... A47B 81/005 211/64
3,291,317 A * 12/1966 Bowen ..... F41A 23/18 248/220.21
3,361,265 A * 1/1968 Wernimont ..... A47B 81/005 248/176.1
3,468,427 A 9/1969 Leslie
3,566,526 A 3/1971 La Violette
3,840,282 A * 10/1974 Major ..... A47B 81/005 211/60.1
3,913,746 A * 10/1975 Burton ..... A47B 81/005 211/64

(Continued)

FOREIGN PATENT DOCUMENTS

CH 584526 A5 * 2/1977
DE 29600874 U1 * 4/1996
WO WO-2021086894 A1 * 5/2021

*Primary Examiner* — Stanton L Krycinski
(74) *Attorney, Agent, or Firm* — Cramer Patent & Design, PLLC; Aaron R. Cramer

(57) ABSTRACT

A firearm ready access display rack is a specialized gun rack having an upper gun stand on an upper stand surface, a plurality of clip and gun accessory retaining devices on a lower stand surface an additional gun or accessory display adjacent the plurality of clip and gun accessory retaining devices. The upper gun stand has at least one Neodymium magnet retention device. The retention device may have a locking mechanism.

19 Claims, 5 Drawing Sheets

(56) References Cited

U.S. PATENT DOCUMENTS 3,964,613 A * 6/1976 Anderson, Jr. ..... F41A 29/00 312/902
4,232,919 A * 11/1980 Stewart ..... F41A 29/00 211/64
4,449,314 A * 5/1984 Sorensen ..... F41A 23/00 221/64
4,461,385 A * 7/1984 Clouser ..... A47B 81/005 42/70.11
D277,716 S * 2/1985 Galente ..... D6/552
4,624,372 A * 11/1986 Brolin ..... F41A 17/02 42/70.11
4,807,381 A * 2/1989 Southard ..... A47B 81/005 211/64
4,873,777 A * 10/1989 Southard ..... A47B 81/005 211/64
4,949,559 A * 8/1990 Glines ..... E05B 47/0002 70/279.1
4,971,208 A * 11/1990 Reinfried, Jr. ..... A47B 81/005 211/64
D313,886 S * 1/1991 Southard ..... 211/163
5,143,227 A 9/1992 Schubert
5,265,950 A * 11/1993 Atkinson ..... A47B 81/005 211/64
5,287,972 A * 2/1994 Saathoff ..... A47B 81/005 42/70.11
5,339,966 A * 8/1994 Bastiaans ..... E05B 73/00 211/64
5,344,032 A * 9/1994 Ramsdell ..... A47B 81/005 211/64
5,438,787 A * 8/1995 McMaster ..... F41A 23/18 42/106
5,487,475 A * 1/1996 Knee ..... A47B 81/005 D6/552
5,524,772 A * 6/1996 Simmons ..... A47B 81/005 211/4
D376,927 S * 12/1996 Pinder ..... D21/573
5,621,996 A 4/1997 Mowl, Jr.
5,676,257 A * 10/1997 Adkins ..... A47B 81/005 211/64
5,758,933 A * 6/1998 Clendening ..... A47B 91/02 312/282
5,772,295 A * 6/1998 Sundmark ..... A47B 46/005 312/246
5,937,559 A 8/1999 Jennen
D448,202 S * 9/2001 Brooking ..... D6/657
6,478,165 B1 11/2002 Noble
6,711,845 B2 3/2004 Dubois et al.
6,749,074 B1 * 6/2004 Hileman ..... A47F 7/0028 211/85.7
6,890,138 B1 * 5/2005 Myrick ..... B60P 7/0892 410/97
D651,795 S * 1/2012 Buie, II ..... D3/262
8,360,446 B1 * 1/2013 Hertan ..... B62B 3/005 280/47.35
8,540,086 B2 9/2013 Karst
8,967,741 B2 * 3/2015 Ferone ..... A47B 81/005 312/321.5
9,192,231 B1 * 11/2015 Steffen ..... A47B 81/005
9,782,000 B2 * 10/2017 Kahle ..... A47B 96/06
9,884,593 B2 * 2/2018 Hull ..... B60R 7/14
10,206,502 B2 * 2/2019 Nye ..... A47B 57/585
10,508,881 B2 12/2019 Peterson
10,542,738 B2 * 1/2020 Moses ..... A47F 7/0035
10,722,027 B2 * 7/2020 Pintar ..... F41A 17/06
2005/0230334 A1 * 10/2005 MacDonald ..... B60R 7/14 211/64
2006/0027473 A1 * 2/2006 Taylor ..... A47B 81/005 42/70.11
2007/0024165 A1 * 2/2007 Moulton ..... A47B 81/005 312/291
2011/0291537 A1 * 12/2011 Baker, Jr. ..... A47B 81/00 312/326
2012/0037579 A1 * 2/2012 Muldoon ..... F41A 23/18 211/64
2013/0229098 A1 * 9/2013 Pletcher ..... E05B 65/46 312/333
2016/0223290 A1 * 8/2016 Jacob ..... F41C 33/06
2017/0030110 A1 * 2/2017 Sahjian ..... A47B 81/00
2018/0160806 A1 * 6/2018 Honermann ..... F41C 33/06
2019/0045922 A1 * 2/2019 Jacobs ..... A01K 97/10
2021/0156644 A1 * 5/2021 Mack ..... A47B 96/061
2021/0267373 A1 * 9/2021 Steere ..... A47B 96/025
2022/0167743 A1 * 6/2022 Dunn ..... A47B 46/005

* cited by examiner

FIREARM READY ACCESS DISPLAY RACK

RELATED APPLICATIONS

Non-applicable.

FIELD OF THE INVENTION

The present invention relates generally to a firearm display rack and more specifically to a firearm display rack having ready access to the firearm.

BACKGROUND OF THE INVENTION

Responsible owners of firearms such as rifles, shotguns, handguns, and the like typically keep their weapons locked and out of sight at all times, perhaps in a gun safe or locked cabinet. However, many households do not have the available storage space for a large gun safe. If they do, such safes are typically located in bedrooms. garages, basements, or other areas which are not readily accessible when quick access to a firearm is required.

Finally, many gun owners, especially owners of expensive or rare guns prefer to treat their guns as pieces of art, and are likely to want to display them, but such action allows the firearm to be readily accessed via anyone including children, criminals, and other unauthorized individuals. Accordingly, there exists a need for a means by which all types of firearms can be displayed in a readily accessible location for authorized users but remain unusable for unauthorized users. The development of the firearm ready access display rack fulfills this need.

SUMMARY OF THE INVENTION

To achieve the above and other objectives, the present invention provides for a firearm ready access display rack that has, a rear mounting plate fastened to a structurally substantial vertical surface by a plurality of fasteners, a main shelf, an auxiliary shelf supported underneath the main shelf by a pair of shelf supports, a pair of magazine holders disposed on the underside of the main shelf opposite of the auxiliary shelf, a barrel support disposed on a first side of the main shelf with a butt support on the second side of the main shelf, a magnetic locking system disposed on the barrel support and the butt support, a graphical display area disposed on an upper portion of the rear mounting plate, and a plurality of neodymium magnets coupling the metal plate in place.

The fasteners may be a plurality of bolts. The fasteners may be a plurality of screws. A plurality of magazines may be suspended by the magazine holders. The tamperproof fasteners may be a plurality of screws. The barrel support and the butt support may be set flush with the pair of top plates and may be held in place with adhesive. The graphical display area may be used to display a plurality of visual material. The visual material may include a plurality of names, a plurality of titles, a plurality of descriptions, a plurality of manufacturer logos, or a plurality of pictures. The neodymium magnets may couple the metal plate in place with a force of 95 pounds per square inch. The firearm ready access display rack may further have a magnetic key placed atop the neodymium magnets, thus reversing, or cancelling a magnetic effect of the neodymium magnets and allowing the metal plate and thus the at least one weapon to be removed.

The firearm ready access display rack may include a secure, lockable, display rack for at least one weapon and a plurality of associated accessories. At least one weapon may be a rifle. The butt of the rifle may be secured within the butt support, while the barrel is secured within the barrel support. At least one weapon may be one or more handguns. The one or more handguns may be positioned such that the grip rests upon the main shelf, while the barrel may be supported by a center stand with a holding slots for each barrel of each of the one or more handguns. The firearm ready access display rack may be made of material selected from the group consisting of wooden materials, plywood, or a metal. The firearm ready access display rack may further have a horizontal brace for holding the one or more weapons. The one or more weapons may include one or more hand-based melee weapons. The horizontal brace may be fastened to the rear mounting plate, while the center stand may be fastened to the main shelf.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
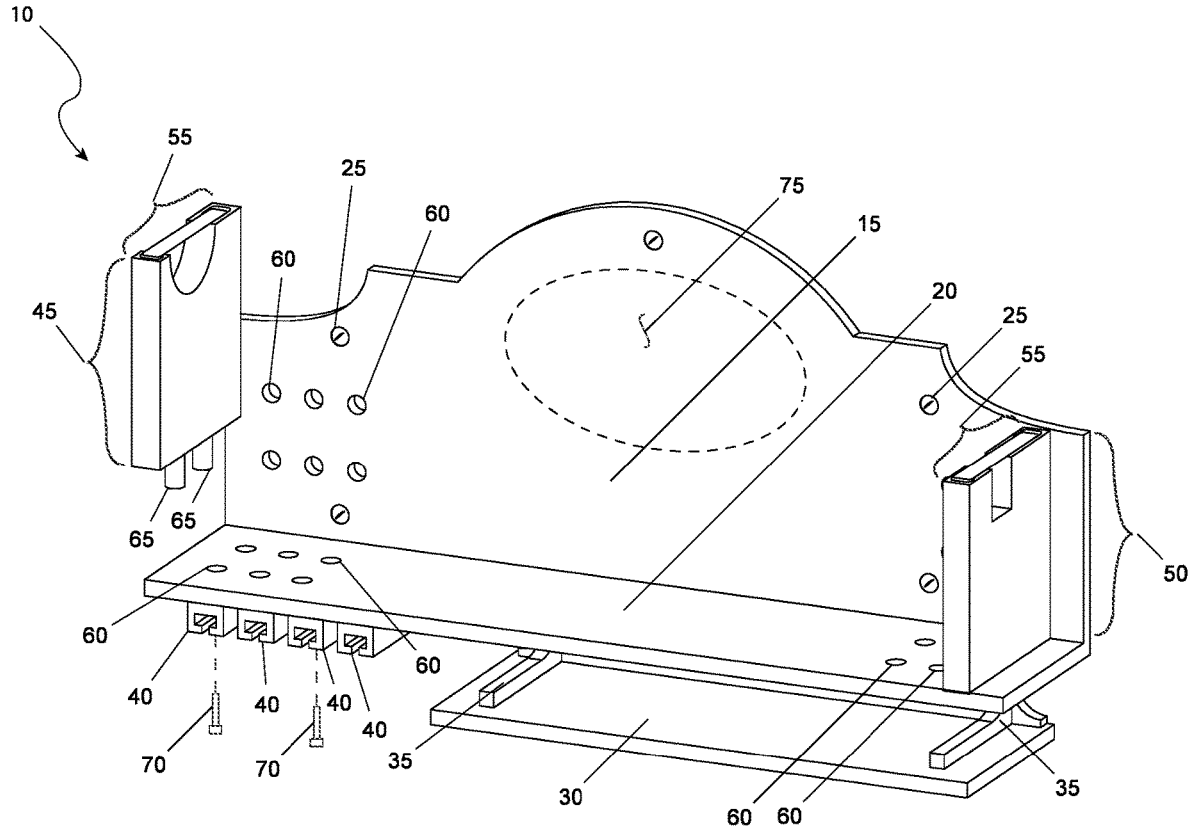
FIG. 1 is a perspective view of the firearm ready access display rack 10, according to the preferred embodiment of the present invention; and, FIG. 2 is a front view of the firearm ready access display rack 10, shown in a utilized state with a rifle 80 according to the preferred embodiment of the present invention.

10 firearm ready access display rack
15 rear mounting plate
20 main shelf
25 fastener
30 auxiliary shelf
35 shelf support
40 magazine holder
45 barrel support
50 butt support
55 magnetic locking system
60 index hole
65 locking pins
70 tamperproof fastener
75 graphical display area
80 rifle
85 butt
90 barrel
95 magazine
100 handgun
105 grip

110 center stand
115 holding slot
120 horizontal brace
125 weapon
130 neodymium magnet
135 top plates
140 metal plate
145 magnetic key
150 T-shaped slot
155 horizontal flange

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the firearm ready access display rack 10, according to the preferred embodiment of the present invention is disclosed. The firearm ready access display rack (herein also described as the "firearm rack") 10, provides for a secure, lockable, display rack for at least one (1) weapon 125 and any associated accessories. The firearm ready access display rack 10 provides for a rear mounting plate 15 and a main shelf 20 arranged at a ninety-degree angle (90°). The rear mounting plate 15 is intended to be fastened to a wall or other suitable, and structurally substantial vertical surface by multiple fasteners 25 such as bolts, screws or similar devices.

An auxiliary shelf 30 is supported underneath the main shelf 20 by two (2) shelf supports 35. The auxiliary shelf 30 is used to store ammunition, accessories, optics, cleaning supplies, and other material or tools commonly utilized during the usage and/or care of a firearm. Multiple magazine holders 40 are provide on the underside of the main shelf 20 opposite of the auxiliary shelf 30. Additional detail on the magazine holders 40 will be provided herein below. A barrel support 45 is located on the left side of the main shelf 20 along with a butt support 50 on the right side of the main shelf 20. Both the barrel support 45 and the butt support 50 are provided with a magnetic locking system 55 which will be described in greater detail herein below. The barrel support 45 and the butt support 50 are attached to the main shelf 20 via a series of adjustable index holes 60 and locking pins 65 (shown only on the barrel support 45 for purposes of illustration) that are secured via tamperproof fasteners 70 such as screws. The adjustable nature of the index holes 60 allow for the display of virtually any size of firearm. Finally, a graphical display area 75 is provided on the upper portion of the rear mounting plate 15. The graphical display area 75 can be used to display various visual material including but not limited to names, titles, descriptions, manufacturer logos, pictures, or the like. The display of any particular item via the graphical display area 75 is not intended to be a limiting factor of the present invention. It is envisioned that the overall size of the firearm rack 10 is approximately thirty inches (30 in.) in width and twenty-five inches (25 in.) in height. The firearm rack 10 would be manufactured from wooden materials such as plywood, although other materials such as metals may also be utilized. The exact composition of materials used, as well as any specific sizes are not intended to be a limiting factor of the present invention.

Figure 2:
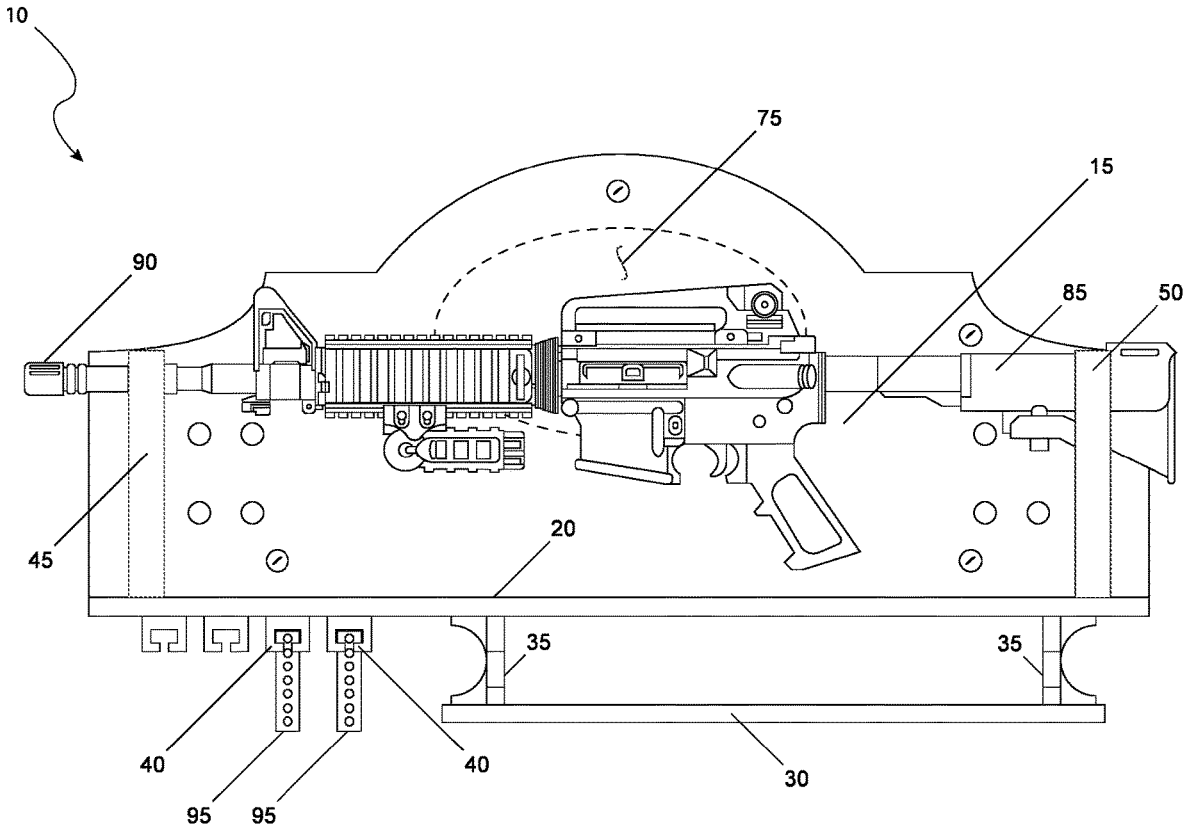

Referring nest to FIG. 2, a front view of the firearm rack 10, shown in a utilized state with a rifle 80 according to the preferred embodiment of the present invention is depicted. The butt 85 of the rifle 80 is secured within the butt support 50, while the barrel 90 is secured within the barrel support 45. As positioned, the rifle 80 cannot be removed from the firearm rack 10 and is safe for general display in an unrestricted environment. Multiple magazines 95 are suspended by the magazine holders 40.

Figure 3:
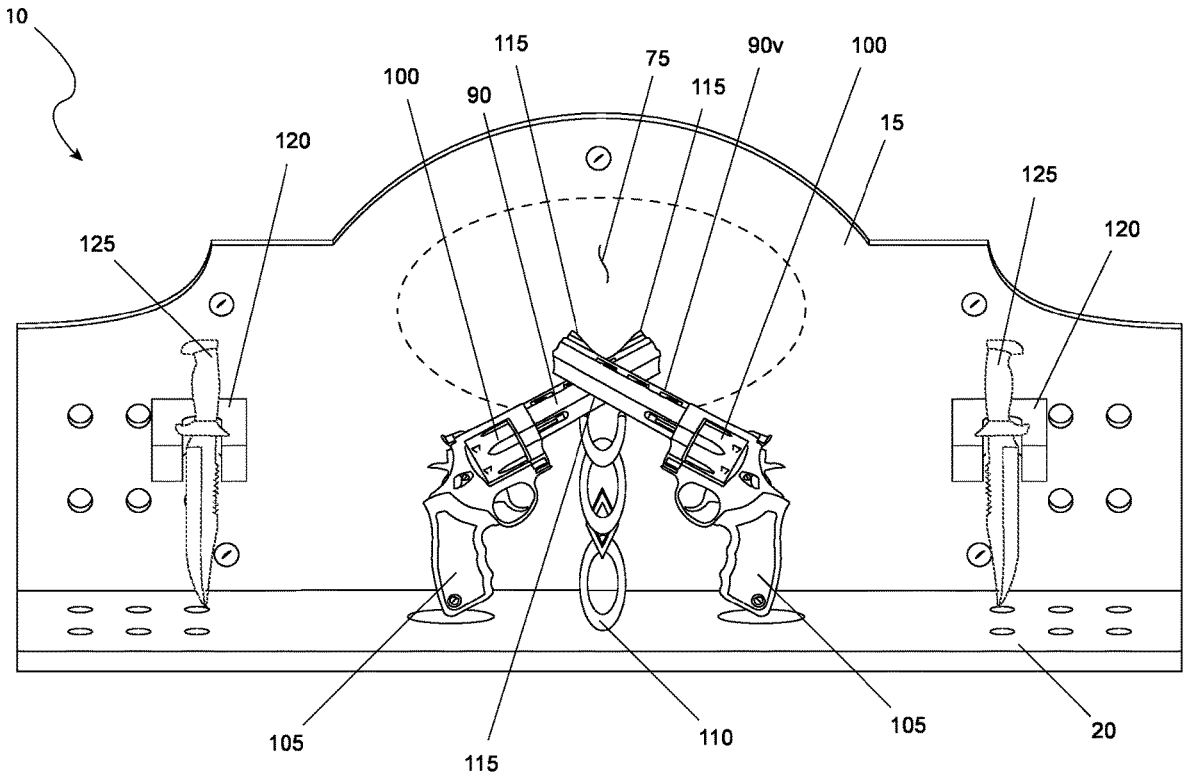
FIG. 3 is a perspective view of the firearm ready access display rack 10, shown in a utilized state with handguns 100, according to the preferred embodiment of the present invention.

Referring now to FIG. 3, a perspective view of the firearm rack 10, shown in a utilized state with handguns 100 according to the preferred embodiment of the present invention is shown. One (1) or more handguns 100 are positioned such that the grip 105 rests upon the main shelf 20, while the barrel 90 is supported by a center stand 110 with a holding slots 115 for each barrel 90. Additionally, the firearm rack 10, may also provide a horizontal brace 120 for holding weapons 125 for holding weapons 125 such as knives (as shown) or other hand-based melee weapons. The horizontal brace 120 is fastened to the rear mounting plate 15, while the center stand 110 is fastened to the main shelf 20. As before, the graphical display area 75 remains present. The magazine holders 40, the barrel support 45, and the butt support 50 (all of which are shown in FIGS. 1 and 2) have been removed, as they are not needed in this configuration.

Figure 4:
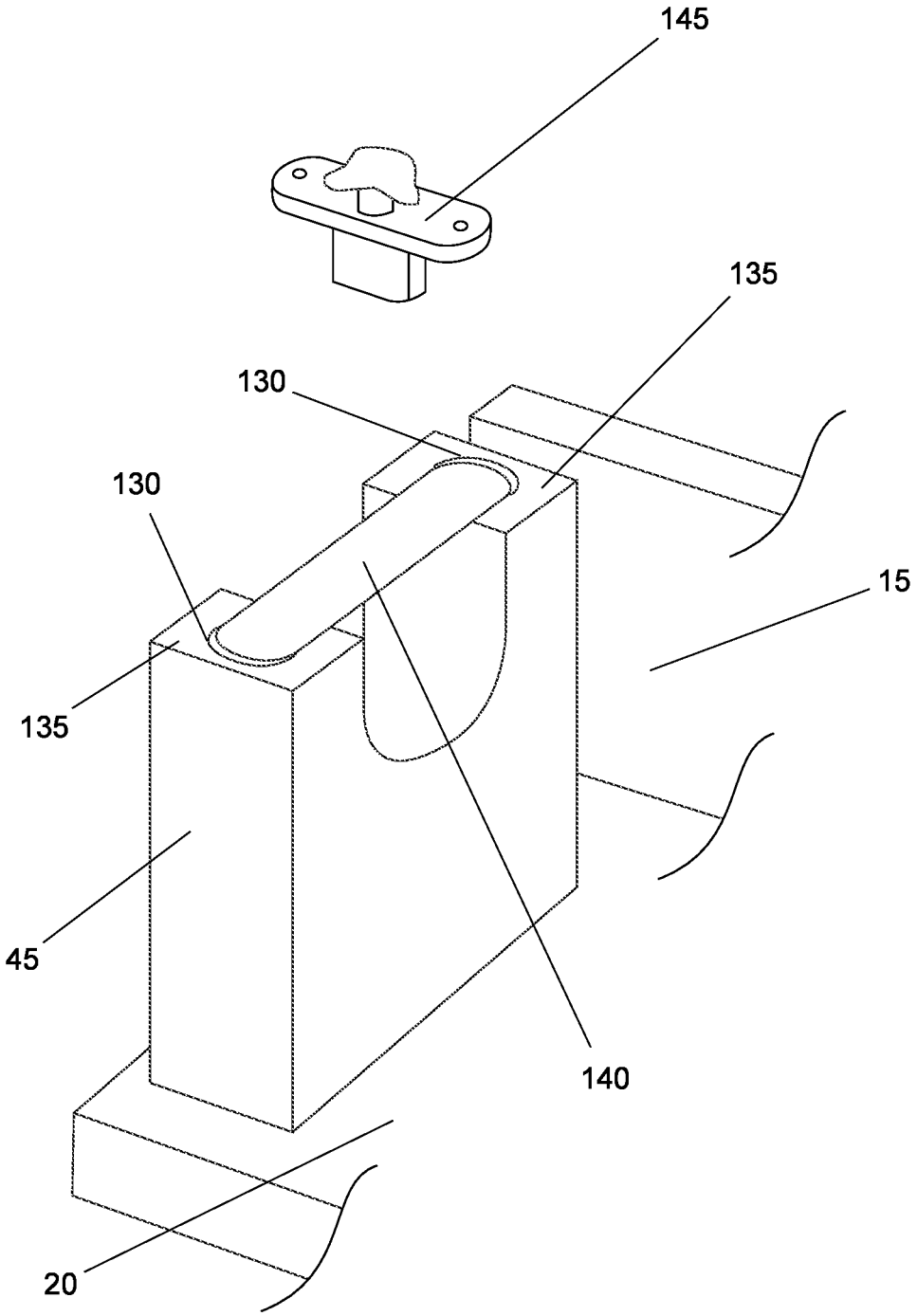
FIG. 4 is a detailed perspective view of the barrel support 45, as used with the firearm ready access display rack 10, according to the preferred embodiment of the present invention; and, FIG. 5 is a detailed perspective view of the magazine holders 40, as used with the firearm ready access display rack 10, according to the preferred embodiment of the present invention

Referring next to FIG. 4, a detailed perspective view of the barrel support 45, as used with the firearm rack 10, according to the preferred embodiment of the present invention is disclosed. The barrel support 45 as attached to the main shelf 20 with the rear mounting plate 15 in the rear background as aforementioned described. It is noted that FIG. 4 depicts the barrel support 45, however, the butt support 50 (as shown in FIG. 1) operates in a typical manner. Two (2) are set flush with the two (2) top plates 135 and are held in place with adhesive. The neodymium magnets 130 would be approximately three-quarters of an inch (¾ in.) in diameter. A metal plate 140 is placed across both neodymium magnets 130 once the rifle 80 (as shown in FIG. 2) is in place. Once the metal plate 140 is positioned, the neodymium magnets 130 will hold it with a force of approximately ninety-five pounds per square inch (95 lbs./inch). When the rifle 80 is to be removed by an authorized user, a magnetic key 145 is placed atop the neodymium magnets 130, thus reversing or cancelling the magnetic effect of the neodymium magnets 130 and allowing the metal plate 140 and thus the rifle 80 to be removed.

Figure 5:
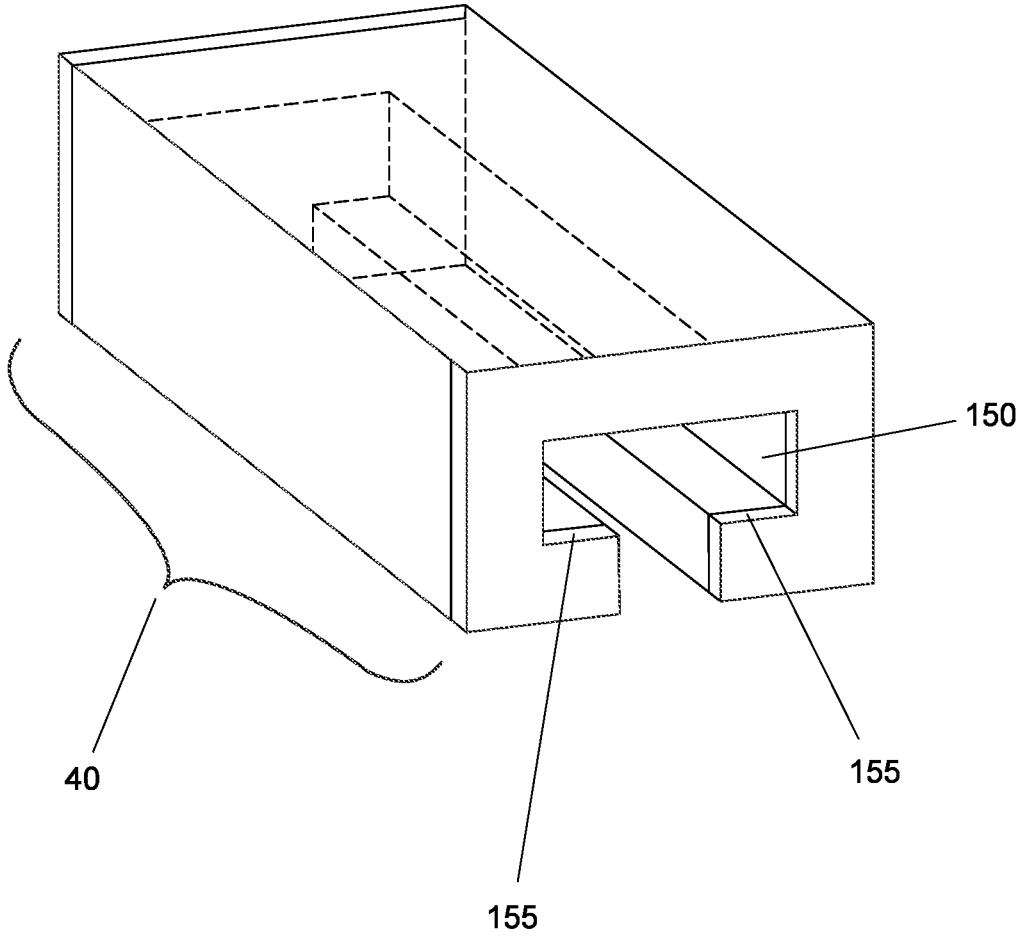

Referring finally to FIG. 5, a detailed perspective view of the magazine holders 40, as used with the firearm rack 10, according to the preferred embodiment of the present invention is depicted. The magazine holders 40 is provided with a T-shaped slot 150, thus producing two (2) horizontal flanges 155. The horizontal flanges 155 serves a bearing surface the lip found on all magazines. As such, the magazine will be displayed upside down with the lip from the slide holding the bottom of the magazine.

2. Operation of the Preferred Embodiment

The preferred embodiment of the present invention can be utilized by the common user in a simple and effortless manner with little or no training. It is envisioned that the firearm ready access display rack 10 would be constructed in general accordance with FIG. 1 through FIG. 5. The user would procure the firearm ready access display rack 10 from conventional procurement channels such as sporting goods stores, discount stores, department stores, mail order and internet supply houses and the like. Special attention would be paid to the type and size of the rifle 80, handguns 100 and/or weapons 125 to be displayed on the firearm rack 10, such that they properly fit.

After procurement and prior to utilization, the firearm ready access display rack 10 would be prepared in the following manner: the rear mounting plate 15 of the firearm rack 10 would be attached to a vertical surface via use of the fasteners 25; the rifle 80 would be secured in the barrel support 45 and the butt support 50 using the metal plate 140 atop the neodymium magnets 130; the handguns 100 would be placed in the holding slots 115 of the center stand 110; and any weapons 125 would be placed in the horizontal brace 120. The user would also be able to store magazines in the magazine holders 40, and other accessories, supplies, and/or tools on the auxiliary shelf 30. At this point in time, the firearm rack 10 is ready for utilization.

During utilization of the firearm rack 10, the following procedure would be initiated: should access be required to the rifle 80, the magnetic key 145 is placed atop the neodymium magnets 130, thus reversing or cancelling the magnetic effect of the neodymium magnets 130 and allowing the metal plate 140 and thus the rifle 80 to be removed. In the instance of the handguns 100 and/or the weapons 125, they are simply lifted free of the center stand 110 and/or the horizontal brace 120 respectively.

After use of the firearm rack 10, the rifle 80, the handguns 100, and/or the weapons 125 is simply replaced following the above-described process, thus keeping said items protected and secured, but ready for rapid use at any time.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A firearm ready access display rack, comprising:

a rear mounting plate fastened to a structurally substantial vertical surface by a plurality of fasteners;

a main shelf extending from the rear mounting plate;

an auxiliary shelf supported underneath the main shelf by a pair of shelf supports;

a pair of magazine holders disposed on the underside of the main shelf opposite of the auxiliary shelf;

a barrel support disposed on a first side of the main shelf with a butt support on a second side of the main shelf;

a magnetic locking system disposed on the barrel support and the butt support;

a graphical display area disposed on an upper portion of the rear mounting plate; and a plurality of neodymium magnets coupling a metal plate of the magnetic locking system in place.

2. The firearm ready access display rack, according to claim 1, wherein the fasteners are a plurality of bolts.

3. The firearm ready access display rack, according to claim 1, wherein the fasteners are a plurality of screws.

4. The firearm ready access display rack, according to claim 1, wherein a plurality of magazines is suspended by the magazine holders.

5. The firearm ready access display rack, according to claim 1, wherein the fasteners are a plurality of tamperproof screws.

6. The firearm ready access display rack, according to claim 1, wherein the barrel support and the butt support are set flush with a_pair of top plates and are held in place with adhesive.

7. The firearm ready access display rack, according to claim 1, wherein the graphical display area is used to display a plurality of visual material.

8. The firearm ready access display rack, according to claim 7, wherein the visual material includes a plurality of names, a plurality of titles, a plurality of descriptions, a plurality of manufacturer logos, or a plurality of pictures.

9. The firearm ready access display rack, according to claim 1, wherein the neodymium magnets couple the metal plate in place with a force of 95 pounds per square inch.

10. The firearm ready access display rack, according to claim 1, further comprising a magnetic key placed atop the neodymium magnets, thus reversing or cancelling a magnetic effect of the neodymium magnets and allowing the metal plate and thus at least one weapon to be removed.

11. The firearm ready access display rack, according to claim 1, wherein the firearm ready access display rack includes a secure, lockable, display rack for at least one weapon and a plurality of associated accessories.

12. The firearm ready access display rack, according to claim 1, further comprising at least one weapon, the at least one weapon is a rifle.

13. The firearm ready access display rack, according to claim 1, wherein a butt of a rifle is secured within the butt support, while a barrel is secured within the barrel support.

14. The firearm ready access display rack, according to claim 1, further comprising at least one weapon, the at least one weapon is one or more handguns.

15. The firearm ready access display rack, according to claim 14, wherein the one or more handguns are positioned such that a grip rests upon the main shelf, while a barrel of each of the one or more handguns is supported by a center stand with holding slots for each barrel of each of the one or more handguns.

16. The firearm ready access display rack, according to claim 1, wherein the firearm ready access display rack is made of material selected from the group consisting of wooden materials, plywood, or a metal.

17. The firearm ready access display rack, according to claim 1, further comprising a horizontal brace for holding a-one or more weapons.

18. The firearm ready access display rack, according to claim 17, wherein the one or more weapons include one or more hand-based melee weapons.

19. The firearm ready access display rack, according to claim 1, wherein a horizontal brace is fastened to the rear mounting plate, while a center stand is fastened to the main shelf.

* * * * *